US006421421B1

(12) United States Patent
McGeoch

(10) Patent No.: US 6,421,421 B1
(45) Date of Patent: Jul. 16, 2002

(54) EXTREME ULTRAVIOLET BASED ON COLLIDING NEUTRAL BEAMS

(75) Inventor: Malcolm W. McGeoch, Brookline, MA (US)

(73) Assignee: Plex, LLC, Brookline, MA (US)

( * ) Notice: Subject to any disclaimer, the term of this patent is extended or adjusted under 35 U.S.C. 154(b) by 0 days.

(21) Appl. No.: 09/815,633

(22) Filed: Mar. 23, 2001

Related U.S. Application Data

(60) Provisional application No. 60/206,130, filed on May 22, 2000.

(51) Int. Cl.[7] ..... G21G 4/00; H01J 35/00

(52) U.S. Cl. ..... 378/119; 250/251; 315/111.81; 315/111.91

(58) Field of Search ..... 250/251; 315/111.21, 315/111.61, 111.71, 111.81, 111.91; 378/119

(56) References Cited

U.S. PATENT DOCUMENTS

| | | | | |
|---|---|---|---|---|
| 3,258,402 A | | 6/1966 | Farnsworth | 376/107 |
| 3,386,883 A | | 6/1968 | Farnsworth | 376/107 |
| 3,530,497 A | | 9/1970 | Hirsch et al. | 376/107 |
| 4,401,618 A | | 8/1983 | Salisbury | 376/106 |
| 4,682,033 A | | 7/1987 | Martin et al. | 250/363.02 |
| 5,126,638 A | * | 6/1992 | Dethlefsen | 315/326 |
| 5,315,629 A | | 5/1994 | Jewell et al. | 378/74 |
| 5,502,356 A | | 3/1996 | McGeoch | 315/111.91 |
| 5,504,795 A | | 4/1996 | McGeoch | 379/119 |
| 5,577,092 A | | 11/1996 | Kublak et al. | 378/119 |
| 6,075,838 A | | 6/2000 | McGeoch | 378/119 |
| 6,188,746 B1 | * | 2/2001 | Miley et al. | 378/119 |

FOREIGN PATENT DOCUMENTS

WO WO95/30235 9/1995

OTHER PUBLICATIONS

Malcolm W. McGeoch, "Radio Frequency Pre–ionized Xenon Z–Pinch Source for Extreme Ultraviolet Lithography", Applied Optics, 1998, pp. 1651–1658.

B.I. Kikiani et al, "Resonance Charge Exchange of Inert–Gas Ions in the Energy Range 200–4000V", Amer. Inst. of Physics, Sov. Phys. Tech. Phys., vol. 20, No. 3, 1975, pp. 364–367.

K.K. Jain et al, "Repetitive High Current Density Pseudospark–Produced Ion Beams", Appl. Phys. Lett., vol. 62, No. 13, Mar. 29, 1993, pp. 1466–1468.

J. Christiansen et al, "Production of High Current Particle Beams by Low Pressure Spark Discharge", Zeitschrift fur Physik A, 290, pp. 35–41, 1979.

* cited by examiner

*Primary Examiner*—Robert H. Kim
*Assistant Examiner*—Allen C. Ho
(74) *Attorney, Agent, or Firm*—Wolf, Greenfield & Sacks, P.C.

(57) ABSTRACT

A source of photons includes a discharge chamber, a plurality of ion beam sources in the discharge chamber and a neutralizing mechanism. Each of the ion beam sources electrostatically accelerates a beam of ions of a working gas toward a plasma discharge region. The neutralizing mechanism at least partially neutralizes the ion beams before they enter the plasma discharge region. The neutralized beams enter the plasma discharge region and form a hot plasma that radiates photons. The photons may be in the soft X-ray or extreme ultraviolet wavelength range and, in one embodiment, have wavelengths in a range of about 10–15 nanometers.

37 Claims, 5 Drawing Sheets

EXTREME ULTRAVIOLET BASED ON COLLIDING NEUTRAL BEAMS

CROSS-REFERENCE TO RELATED APPLICATION

This application claims the benefit of Provisional Application Serial No. 60/206,130, filed May 22, 2000, which is hereby incorporated by reference.

FIELD OF THE INVENTION

This invention relates to plasma X-ray sources and, more particularly, to sources of soft X-ray or extreme ultraviolet photons, wherein high power production of photons is achieved by electrostatic acceleration of ions toward a plasma discharge region, followed by neutralization of the ions so as to avoid space charge repulsion as the discharge region is approached.

BACKGROUND OF THE INVENTION

A high power bright source of extreme ultraviolet or soft X-ray photons is required for the process of optical lithography using a scanning ringfield camera or other imaging system. Ringfield lithography is described, for example, in U.S. Pat. No. 5,315,629 issued May 24, 1994 to Jewell et al. The wavelength range of 12.5 to 14.5 nanometers is particularly useful for this purpose, because in this band a relatively highly reflecting mirror based on a silicon and molybdenum multilayer is available. Another nearby wavelength, 11.4 nanometers, is also of interest because of the available silicon and beryllium multilayer mirror.

The xenon band emission between 10 nanometers and 15 nonometers has been proposed for the generation of these lithographic wavelengths via the emission of a plasma created by focusing a pulsed laser onto a xenon cluster expansion. See, for example, U.S. Pat. No. 5,577,092 issued Nov. 19, 1996 to Kubiak et al. The xenon plasma that results must reach a temperature of more than 20 eV (electron volts) in order to contain the highly ionized xenon species that radiate in the desired band. Conversion from laser energy to usable 13.5 nanometer photon energy is less than 1% efficient, with the consequence that a very high power (multiple kilowatt) laser is required. Such lasers have high capital and operating costs. Two other disadvantages of the laser-produced plasma approach are: (a) the collection optical elements must be close to the plasma in order to collect a large solid angle of the emitted radiation, with the consequence that xenon ions from the plasma damage the collection surface by sputtering, and (b) the nozzle that produces the cluster expansion must be within approximately 2 millimeters of the plasma for the process to work. This causes nozzle erosion and leads to material deposition on the collecting optics and subsequent degradation of the extreme ultraviolet reflectivity of the collecting optics.

A more direct method for the generation of 10–15 nanometer xenon band radiation is the magnetic acceleration of xenon ions toward the axis of a pulsed cylindrical discharge known as a Z-pinch discharge. This technique is disclosed, for example, in U.S. Pat. No. 5,504,795, issued Apr. 2, 1996 to McGeoch and in McGeoch, "Radio Frequency Pre-ionized Xenon Z-pinch Source for Extreme Ultraviolet Lithography," *Applied Optics,* Vol. 37, pages 1651–1658, 1998. The source includes a chamber defining a pinch region having a central axis, an RF electrode disposed around the pinch region for pre-ionizing the gas in the pinch region to form a plasma shell that is symmetrical around the central axis in response to application of RF energy to the RF electrode, and a pinch anode and a pinch cathode disposed at opposite ends of the pinch region. An X-radiating gas is introduced into the chamber at a typical pressure level between 0.1 torr and 10 torr. The pinch anode and the pinch cathode produce a current through the plasma shell in an axial direction and produce an azimuthal magnetic field in the pinch region in response to application of a high energy electrical pulse to the pinch anode and the pinch cathode. The azimuthal magnetic field causes the plasma shell to collapse to the central axis and to generate X-rays.

The Z-pinch source directly converts electrical energy into plasma energy, with relatively high efficiency. Approximately 10% of the delivered electrical energy is radiated in the xenon band. However, because the radiating plasma is several times larger than the one produced by focusing a laser, a smaller solid angle of the radiation can be collected and directed into the lithographic optics which has limited etendue. The net efficiency gain is therefore reduced to a smaller factor, in the range of 2–4 times. An advantage of the smaller collection angle of the Z-pinch source is that the collection optical surface is far enough distant from the pinch region not to be damaged by xenon ions. The smaller collected photon beam angles also allow the insertion, between the plasma and the collection optics, of a foil trap or other device for the removal of contaminants and particulates to protect the collection optics over a long operational life.

A disadvantage of the Z-pinch source arises from the fact that ion acceleration occurs as the result of forces on the electrons in the discharge plasma. The electrons flow in a cylindrical sheet between discharge cathode and anode, and a return current flows through an outer conducting cylinder. Between these cylindrical current sheets, a strong magnetic field provides pressure to accelerate the plasma sheet toward the Z-pinch axis. However, the cost of generating the plasma sheet is that electrons must be extracted from the Z-pinch electrode, and this process is associated with small but inevitable rates of electrode erosion due to sputtering of electrode material by the incident xenon ions from the discharge.

A device known as the fusor, in which ions are accelerated toward the center of a sphere in order to create fusion reactions, has been studied. Such devices are disclosed, for example, in U.S. Pat. No. 3,258,402 issued June, 1966 to Farnsworth, U.S. Pat. No. 3,386,883 issued Jun. 4, 1968 to Farnsworth and U.S. Pat. No. 3,530,497 issued Sep. 22, 1970 to Hirsch et al.

All of the known prior art devices have had one or more drawbacks and disadvantages. Accordingly, there is a need for improved methods and apparatus for generating soft X-ray or extreme ultraviolet photons.

SUMMARY OF THE INVENTION

According to a first aspect of the invention, a source of photons comprises a discharge chamber, a plurality of ion beam sources in the discharge chamber, and a neutralizing mechanism. Each of the ion beam sources electrostatically accelerates a beam of ions of a working gas toward a plasma discharge region. The neutralizing mechanism at least partially neutralizes the ion beams before they enter the plasma discharge region. The neutralized beams enter the plasma discharge region and form a hot plasma that radiates photons.

The photons may be in the soft X-ray or extreme ultraviolet wavelength range. In one embodiment, the radiating photons have wavelengths in a range of about 10–15 nanometers.

The ion beam sources may be pulsed or continuous. In one embodiment, the plasma discharge region has a spherical shape and the ion beam sources are distributed around the spherical plasma discharge region. In another embodiment, the plasma discharge region has a cylindrical shape and the ion beam sources are distributed around the cylindrical plasma discharge region.

The plurality of ion beam sources may comprise concentric electrode shells having sets of apertures aligned along axes which pass through the plasma discharge region, a voltage source for applying a voltage between the electrode shells, and a gas source for supplying the working gas to the sets of apertures in the electrode shells. The electrode shells may comprise a cathode shell and an anode shell. The electrode shells may further comprise one or more intermediate shells between the cathode shell and the anode shell. The electrode shells may be configured to produce pseudospark discharges and, more particularly, may be configured to produce tandem pseudospark discharges.

In one embodiment, the neutralizing mechanism comprises resonant charge exchange in each of the ion beams. In another embodiment, the ion beams are neutralized by the introduction of electrons.

The working gas may be selected from the group consisting of xenon, lithium, helium, neon, argon and krypton, but is not limited to these gases. The working gas pressure in the discharge chamber is preferably in a range of about 1–100 millitorr.

According to another aspect of the invention, a photon source comprises a discharge chamber containing a working gas, concentric electrode shells in the discharge chamber, a voltage source for applying a voltage between the electrode shells, and a neutralizing mechanism. The electrode shells have sets of apertures aligned along axes which pass through a plasma discharge region. Beams of ions of the working gas are directed along the axes toward the plasma discharge region. The neutralizing mechanism at least partially neutralizes the ion beams before they enter the plasma discharge region. The neutralized beams enter the plasma discharge region and form a hot plasma that radiates photons.

According to a further aspect of the invention, a system for generating photons is provided. The system comprises a housing defining a discharge chamber, concentric electrode shells located in the discharge chamber, a voltage source for applying a voltage between the electrode shells, a gas source for supplying a working gas to the discharge chamber, a neutralizing mechanism, and a vacuum system for controlling the pressure of the working gas in the discharge chamber. The electrode shells have sets of apertures aligned along axes which pass through a plasma discharge region. Beams of ions of the working gas are directed along the axes toward the plasma discharge region. The neutralizing mechanism at least partially neutralizes the ion beams before they enter the plasma discharge region, wherein the neutralized beams enter the plasma discharge region and form a hot plasma that radiates photons.

The gas source and the vacuum system may be connected to provide circulation of the working gas through the discharge chamber.

The system may further comprise a feedback control system for controlling the rate of flow of the working gas into the discharge chamber in response to a measured spectrum of the radiated photons. The feedback control system may comprise a photon detector for detecting the spectrum of the radiated photons and a flow controller responsive to the measured photon spectrum for controlling the flow of the working gas into the discharge chamber.

The housing may include a structure for passing the radiated photons to a collection region. The structure may comprise a honeycomb screen having a plurality of holes aligned with the direction of propagation of the radiated photons.

According to another aspect of the invention, a method for generating photons is provided. The method comprises the steps of electrostatically accelerating a plurality of beams of ions of a working gas toward a plasma discharge region, and at least partially neutralizing the ion beams before they enter the plasma discharge region, wherein the neutralized beams enter the plasma discharge region and form a hot plasma that radiates photons.

BRIEF DESCRIPTION OF THE DRAWINGS

For a better understanding of the present invention, reference is made to the accompanying drawings, which are incorporated herein by reference and in which.

DETAILED DESCRIPTION

A photon source in accordance with the invention utilizes the acceleration of ions to a discharge region to form a hot plasma which radiates photons. The ions are accelerated by electrostatic force rather than magnetic force. In order to direct the ions to a small discharge volume, the ions are accelerated in geometrically precise acceleration gaps whose axes intersect in the discharge region. The ions can be supplied to the acceleration gaps from an ion source or directly generated within the gaps. In order to radiate extreme ultraviolet photons, the plasma in the discharge region must reach a temperature of 20 eV or greater, but radiation at this temperature is very strong, tending to rapidly cool the plasma. The required temperature can most easily be reached by delivering pulsed ion beams. However, continuous ion beams may be utilized within the scope of the invention. The energy per particle delivered to the central plasma is typically several kilovolts in order to create the high ionization states that recombine and radiate in the extreme ultraviolet or soft X-ray range. In addition, the ions carry positive charge which would repel them from each other before they could reach the discharge region, unless a mechanism is provided for their neutralization. In one embodiment, the accelerated ions undergo resonant charge exchange as they leave the acceleration gap, and are transported to the central location as neutral atoms. In another embodiment, the ion beam is neutralized by the addition of a stream of electrons. The resulting neutralized beams are able to enter the discharge region without being deflected. In the case of resonant charge exchange, the gas pressure is adjusted to achieve substantially complete charge exchange in a distance of a few centimeters, implying a gas pressure in a range of about 1–100 millitorr.

Figure 1A:
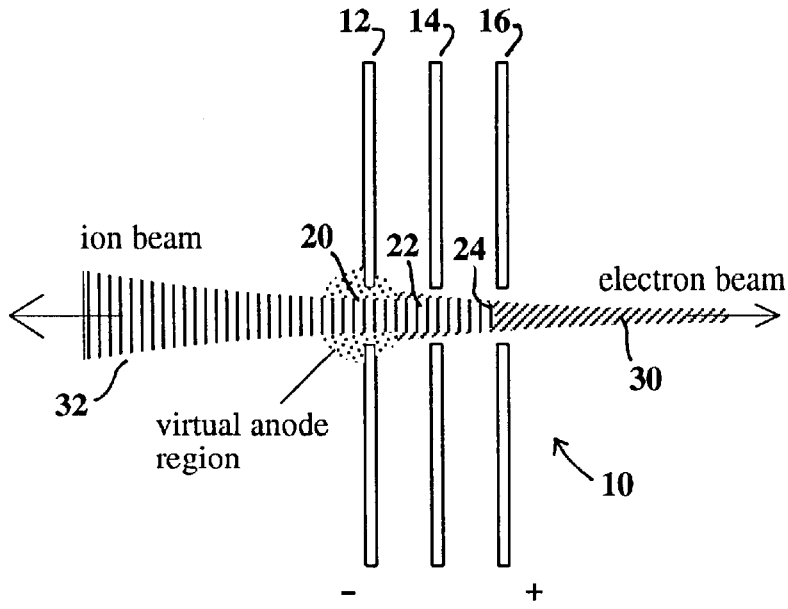
FIG. 1A is a schematic representation of a single pseudospark discharge device.

The ion beams for the photon source can be generated in a pseudospark discharge device, an example of which is shown in FIG. 1A. A pseudospark discharge device 10 includes spaced-apart planar electrodes 12, 14 and 16 having aligned holes 20, 22 and 24, respectively. In FIG. 1A, the pseudospark discharge device 10 includes two series gaps. In general, the pseudospark discharge device can include one to many gaps between end electrodes that act as the anode and the cathode of the pseudospark discharge. The holes 20, 22 and 24 are circular and are aligned on an axis. A working gas, typically in a pressure range of 1–100 millitorr, is is supplied to the discharge device. When a pulsed voltage is applied to the electrodes and plasma formation begins, particle beams leave the gaps in both directions. When a positive pulse is applied to electrode 16, an electron beam 30 exits via hole 24 in anode electrode 16, and an ion beam 32 exits via hole 20 in cathode electrode 12. The intermediate electrodes, such as electrode 14, can float at an intermediate potential or can be biased in order to aid in focusing the generated particle beams. The intermediate electrodes also allow lower gas density to be used for a given pulsed voltage, which reduces extreme ultraviolet absorption.

Figure 2A:
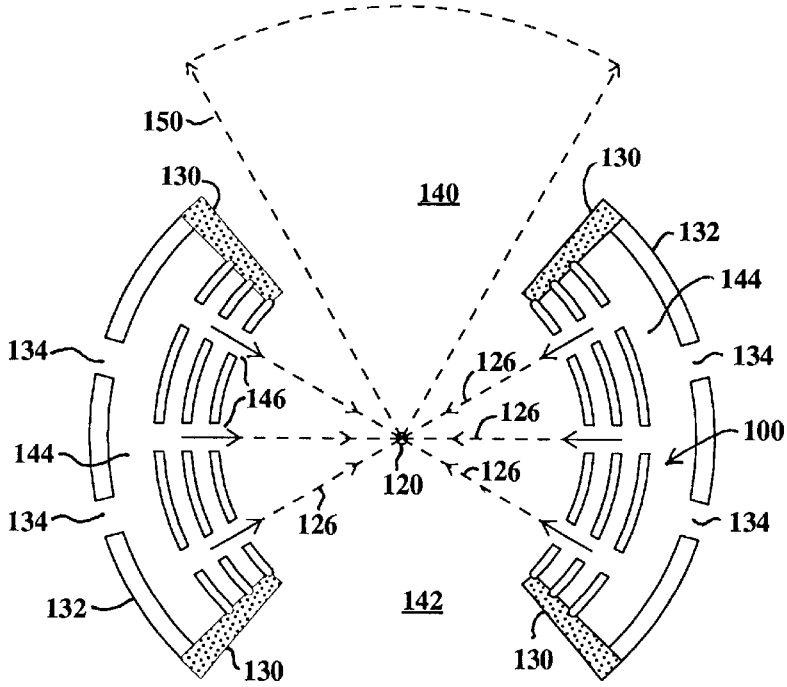
FIG. 2A is a cross-sectional side view of a first embodiment of an extreme ultraviolet source in accordance with the invention.
Figure 2B:
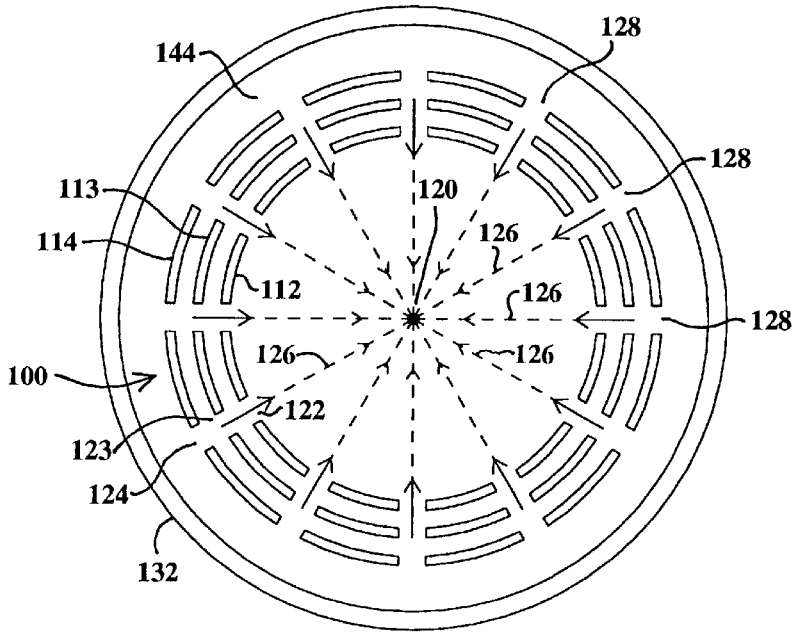
FIG. 2B is a cross-sectional top view of the extreme ultraviolet source shown in FIG. 2A.

A first embodiment of a photon source in accordance with the invention is shown in FIGS. 2A and 2B. The embodiment of FIGS. 2A and 2B has a two gap ion acceleration structure 100. Acceleration structure 100 includes concentric spherical electrode shells 112, 113 and 114. The electrode shells 112, 113 and 114 have a plurality of sets of holes aligned along axes which pass through a central plasma discharge region 120. Thus, for example, holes 122, 123 and 124 in electrode shells 112, 113 and 114, respectively, are aligned along an axis 126 that passes through plasma discharge region 120. Each set of holes, such as holes 122, 123 and 124, defines an acceleration column 128. The spaces between electrode shells 112, 113 and 114 constitute acceleration gaps for electrostatic acceleration of ion beams. Thus, each acceleration column has two gaps in the embodiment of FIGS. 2A and 2B. The embodiment of FIGS. 2A and 2B includes 36 acceleration columns 128, arrayed in three sets of 12. Thus, the acceleration structure 100 directs 36 ion beams toward plasma discharge region 120. However, different members of ion beams may be utilized within the scope of the invention.

The electrode shells 112, 113 and 114 may be supported by insulating spacers 130. By way of example only, innermost electrode shell 112 may have a diameter of 50 millimeters and the spacing between electrode shells may be on the order of 5–10 millimeters. The aligned holes 122, 123 and 124 in the electrode shells may have diameters on the order of 3 millimeters. It will be understood that these dimensions are given by way of example only and are not limiting as to the scope of the present invention. Acceleration structure 100 may be constructed without intermediate electrode shell 113 or may have two or more intermediate electrode shells.

A plenum 132 having ports 134 encloses acceleration structure 100. A working gas, which can be xenon in the case of generating 10–15 nanometer radiation, is introduced through ports 134 in plenum 132, so as to supply each of the acceleration columns 128 from the end that is farthest from plasma discharge region 120. A central part of the structure is maintained under vacuum by vacuum pumping through a top aperture 140 and/or a bottom aperture 142 in acceleration structure 100.

The working gas pressure in the central part of the acceleration structure 100 is preferably maintained in a range of about 1 to 100 millitorr. As noted above, one suitable working gas is xenon. Other suitable working gases include, but are not limited to, lithium, helium, neon, argon and krypton.

In operation, the working gas is introduced, either in a pulse mode or continuously, through ports 134 into a space 144 behind outermost electrode shell 114. Some of the working gas flows down the acceleration columns 128. When the appropriate gas density is present in the acceleration columns 128, a pulsed voltage may be applied between electrode shells 112 and 114, with the polarity of electrode shell 114 being positive with respect to electrode shell 112. In the configuration of FIGS. 2A and 2B, provided the appropriate gas density is present and provided that sufficient voltage is applied, a pseudospark discharge develops simultaneously in each of the acceleration columns 128. The pseudospark discharge is characterized by the development of oppositely directed electron and ion beams that can have extremely high intensity. The ion beam exits from the negative polarity end of the acceleration column 128 at electrode shell 112, and the electron beam exits from the positive polarity end of the acceleration column at electrode shell 114. The intermediate electrode shell 113 can be held at a selected potential intermediate between electrode shells 112 and 114. Tuning of this intermediate potential can improve the focusing of the ion beam at the plasma discharge region 120.

The voltage applied between electrode shells 112 and 114 is preferably pulsed. Alternatively, a continuous voltage may be utilized. The pulsed voltage preferably has an amplitude of 5–50 kV (kilovolts), a pulse width of 10–1000 nanoseconds and a repetition rate of 1 Hz to 100 kHz. The pulse amplitude is selected to accelerate the ion beams to energies of 100 eV (electron volts) to 10 keV (thousand electron volts). It will be understood that these parameters are given by way of example only and are not limiting as to the scope of the invention. The applied voltages depend on the parameters of the acceleration structure, the parameters of the working gas and the parameters of the radiated photons.

The ion beams generated in the acceleration columns 128 are electrostatically accelerated to plasma discharge region 120, so as to effectively collide there and rapidly heat a growing plasma that is being added to by the continuing arrival of working gas atoms in the ion beams. By correct adjustment of the working gas density at an exit region 146 of each of acceleration columns 128, most of the ions can be neutralized by resonant charge exchange, so as to form a neutral beam that propagates without deflection to the plasma in plasma discharge region 120. The working gas pressure is preferably in a range of about 1 to 100 millitorr to promote resonant charge exchange. Those ions that are not neutralized contribute excess positive charge to each of the ion beams, causing electrons to be attracted from the nearby surface of electrode shell 112, which is already primed as a cathode due to the breakdown into a pseudospark discharge. Thus, the neutral atoms are accompanied by a nearly charge balanced beam plasma, including the remaining unneutralized ions and electrons, and the beam plasma contributes additional energy to the hot plasma forming at plasma discharge region 120. Plasma discharge region 120 may have a volume in a range of about 0.001 to 0.1 cubic centimeter.

When the plasma reaches a temperature of 20 eV or greater, the charge states that radiate in the extreme ultraviolet are formed and begin to dominate the composition of the central plasma. Radiation of extreme ultraviolet photons occurs both during an energy addition phase, which can last 10–100 nanoseconds, and during a plasma cooling phase, which begins when the neutral beam power decreases and can last 10–100 nanoseconds. By analogy with the inertial Z-pinch source, radiation from the plasma at plasma discharge region 120 may be dominated by recombination transitions, which are fed by the presence of rapidly cooled electrons during the expansion phase. An extreme ultraviolet radiation beam 150 exits through each of the apertures 140 and 142 in acceleration structure 100, but is typically used in only one direction.

Repetitive operation of the photon source of FIGS. 2A and 2B at rates up to tens of kilohertz provides an accurate exposure dose in the scanning ringfield camera of the lithography application. The pseudospark discharge device can regenerate at frequencies in excess of 100 kilohertz. Furthermore, synchronism of multiple pseudospark channels has been demonstrated in a similar electrode geometry that was designed, not as a photon source, but as a high current electrical switch, as disclosed in U.S. Pat. No. 5,502,356, issued May 26, 1996 to McGeoch. At high repetition frequency, in excess of a few kilohertz, a plasma is permanently present within the enclosed volume. The plasma comprises a partially ionized gas that is streaming radially from the plasma discharge region 120 in all directions. The arrival of the plasma stream at the surface of electrode shell 112 releases secondary electrons that initiate each of the column discharges in synchronism, once the voltage pulse has been applied.

Figure 3A:
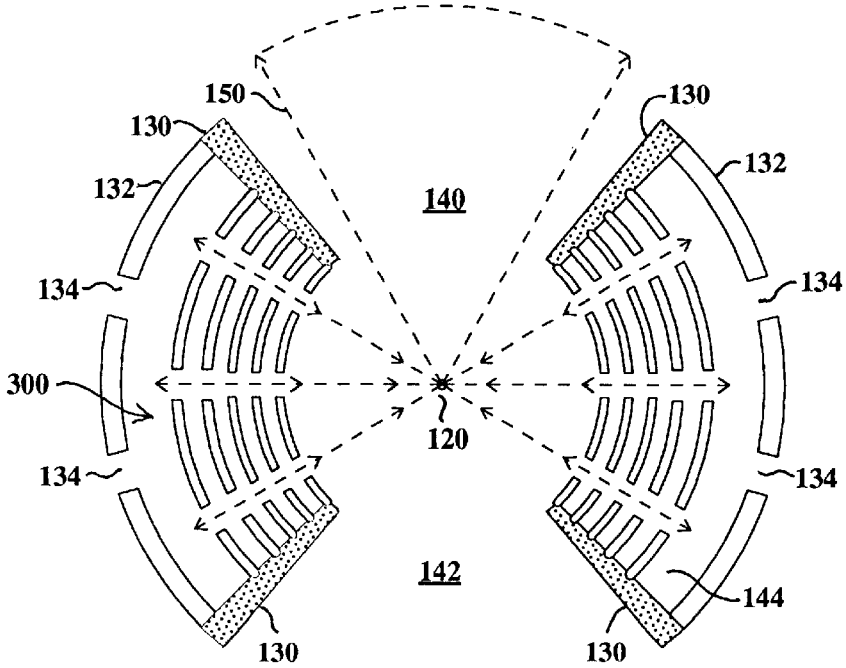
FIG. 3A is a cross-sectional side view of a second embodiment of an extreme ultraviolet source in accordance with the invention.
Figure 3B:
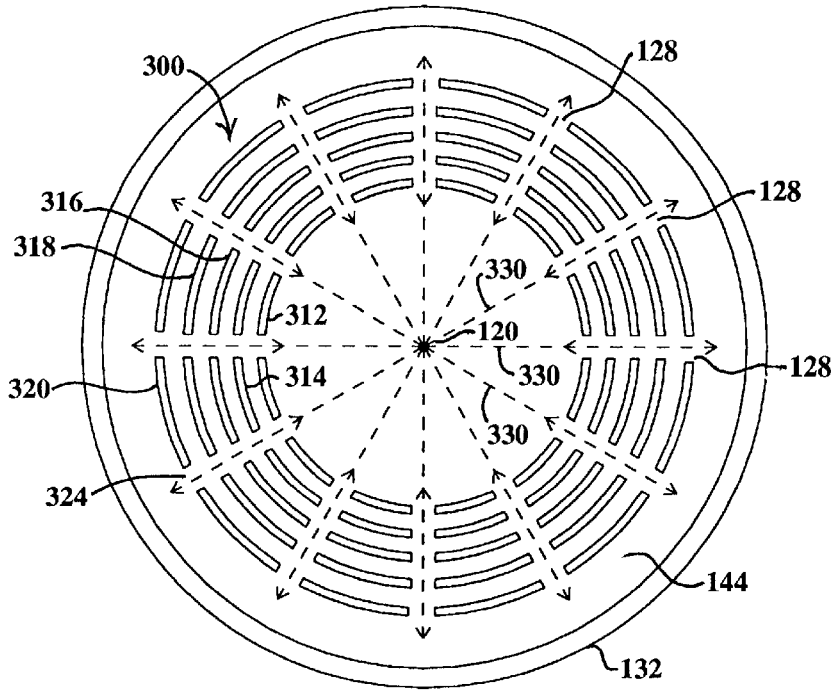
FIG. 3B is a cross-sectional top view of the extreme ultraviolet source shown in FIG. 3A.

A second embodiment of a photon source in accordance with the invention is shown in FIGS. 3A and 3B. Like elements in FIGS. 2A, 2B, 3A and 3B have the same reference numerals. In the embodiment of FIGS. 3A and 3B, the ion beams are neutralized by the addition of co-propagating streams of electrons. The ion and electron beams are generated simultaneously by back-to-back pseudospark devices that are called tandem pseudospark devices.

Figure 1B:
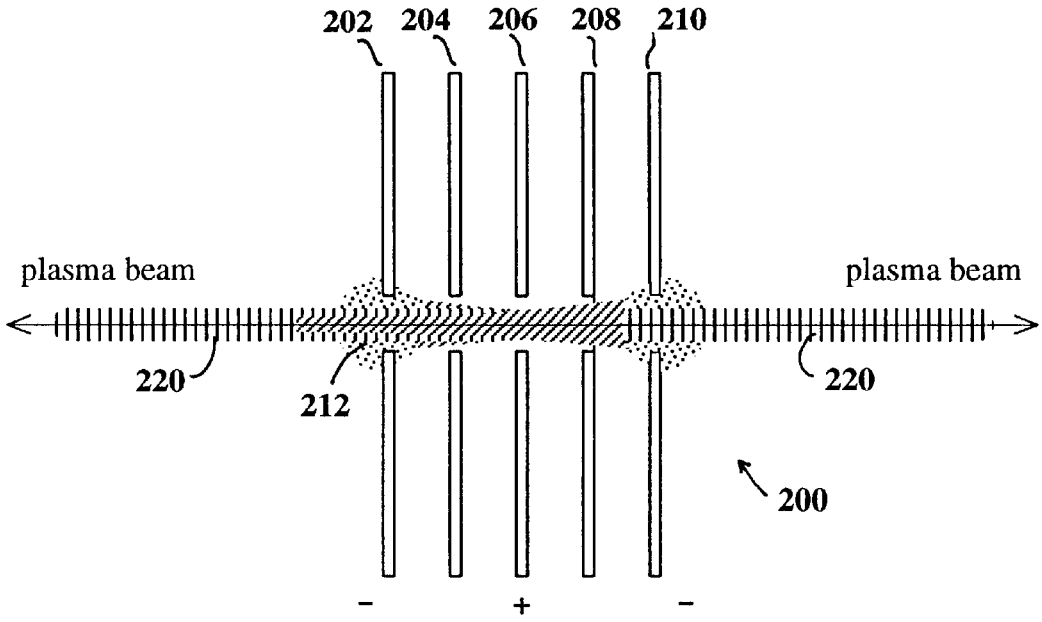
FIG. 1B is a schematic representation of a tandem pseudospark discharge device.

A tandem pseudospark discharge device 200 is illustrated schematically in FIG. 1B. The tandem pseudospark discharge device 200 includes planar electrodes 202, 204,206, 208 and 210 having aligned holes 212. Middle electrode 206 is pulsed positively with respect to electrodes 202 and 210 at each end of the device, thus producing a back-to-back configuration. Electron and ion beams are generated as in the device of FIG. 1A. However, in the back-to-back configuration of FIG. 1B, the electron and ion beams are superimposed on one another, so that the ion beams are accompanied by low energy electrons. The resulting neutral plasma beams 220 propagate without substantial divergence caused by space charge repulsion and approach the discharge region of the photon source without creating a positive potential that would otherwise repel the ions.

Referring again to FIGS. 3A and 3B, an acceleration structure 300 includes concentric spherical electrode shells 312, 314, 316, 318 and 320. The electrode shells 312, 314, 316, 318 and 320 have sets of holes 324 aligned along axes 330 which pass through plasma discharge region 120. The aligned holes 324 define acceleration columns 128.

In operation, xenon gas or other working gas is introduced through ports 134 into space 144 and between electrode shells 312, 314, 316, 318 and 320. The middle electrode shell 316 is pulsed positively with respect to innermost electrode shell 312 and outermost electrode shell 320. Pseudospark discharges ignite simultaneously between electrode shells 316 and 312 and between electrode shells 316 and 320, producing neutral beams along axes 330. The inwardly directed beams converge in plasma discharge region 120 to collide and generate a hot plasma, typically with a temperature of 20–50 eV. When plasma expansion and heating have ceased, the plasma cools and recombines, and radiates extreme ultraviolet photons. As an example, the working gas can be xenon at a pressure of a few millitorr. The plasma in discharge region 120 radiates in the xenon bands between 100 angstroms and 150 angstroms. The structures of the electrode shells, the working gas parameters and the parameters of the applied pulsed voltage can be similar to those described above in connection with the embodiment of FIGS. 2A and 2B.

The plasma discharge region 120 in the embodiments of FIGS. 2A, 2B, 3A and 3B is spherical. However, the plasma discharge region formed by the colliding neutral beams is not necessarily spherical, but can be cylindrical, and ellipsoid, or any other arbitrary shape.

Figure 4A:
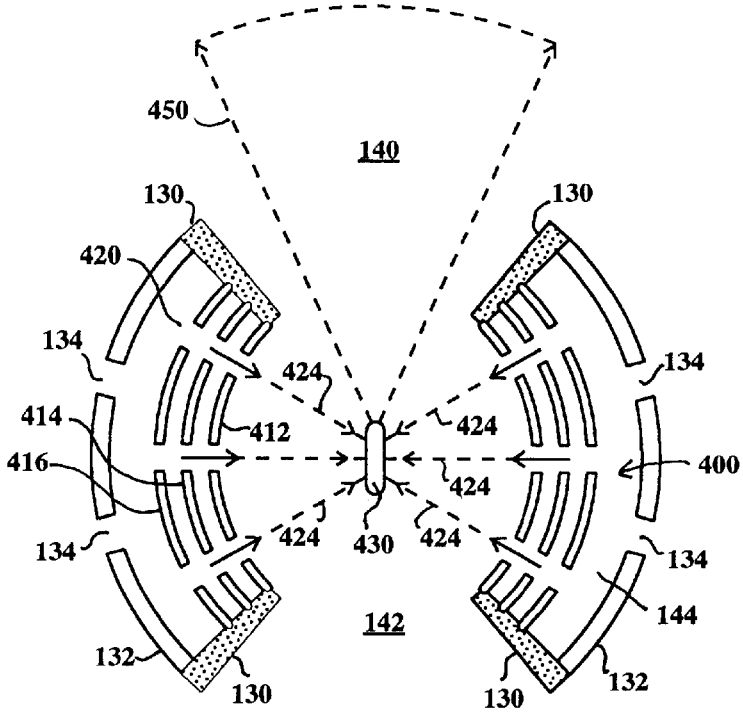
FIG. 4A is a cross-sectional side view of a third embodiment of an extreme ultraviolet source in accordance with the invention.
Figure 4B:
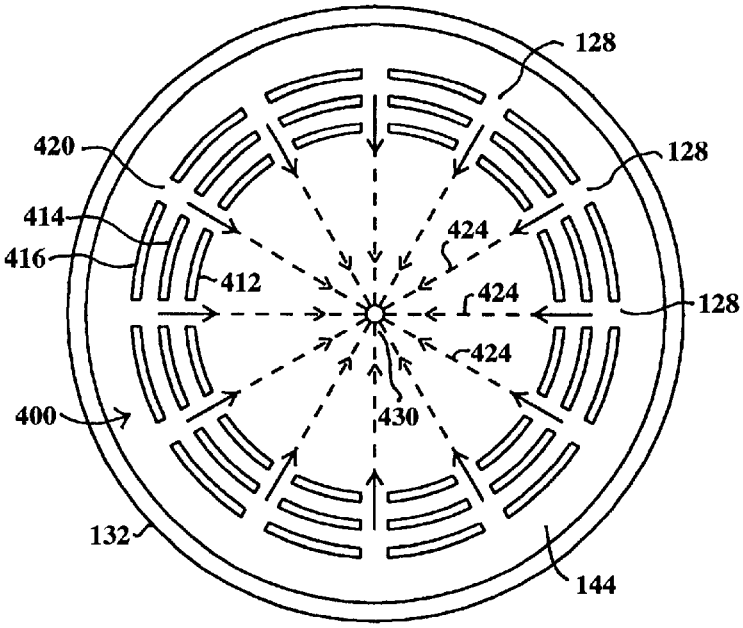
FIG. 4B is a cross-sectional top view of the extreme ultraviolet source shown in FIG. 4A.

A third embodiment of a photon source in accordance with the invention, having a cylindrical plasma discharge region, is shown in FIGS. 4A and 4B. Like elements in FIGS. 2A, 2B, 4A and 4B have the same reference numerals. In the embodiment of FIGS. 4A and 4B, an acceleration structure 400 includes concentric electrode shells 412, 414 and 416. Electrode shells 412, 414 and 416 have sets of holes 420 aligned along axes 424 which pass through a cylindrical plasma discharge region 430. The sets of holes 420 define acceleration columns 128.

In the embodiment of FIGS. 4A and 4B, the working gas is introduced through ports 134 in plenum 132 to the acceleration structure 400 so as to be substantially uniformly distributed in space 144 and between electrode shells 412, 414 and 416. A pulsed voltage is applied between electrode shells 412 and 416, with electrode shell 414 held at an intermediate potential. The geometry of the electrode shells 412, 414 and 416 is such that the beams generated in acceleration columns 128 converge to cylindrical plasma discharge region 430. As in the embodiments of FIGS. 2A, 2B, 3A and 3B, the beams are neutralized by resonant charge exchange and/or include ions accompanied by neutralizing electrons. The energy carried by the beams is deposited into the plasma in the discharge region 430 to create highly ionized species that radiate in the soft X-ray or extreme ultraviolet region of the spectrum. The radiation exits the source as a beam 450, while the hot plasma is exhausted from the source through aperture 142.

The photon source of FIGS. 4A and 4B may be constructed without intermediate electrode shell 414 or may be constructed with two or more intermediate shells. The photon source may be constructed to incorporate a tandem pseudospark discharge device, as shown in FIGS. 1A, 3A and 3B and described above.

The cylindrical plasma in discharge region 430 emits extreme ultraviolet radiation more strongly in the axial direction of the cylindrical discharge region than in the radial direction. Directional radiation can occur when an elongated plasma emits recombination radiation. Projection of radiation into a narrow beam is advantageous when the collecting optical surface, typically a mirror, must be located at a large distance from the plasma, either to reduce plasma heating of the mirror or to permit the use of small incidence angles of the radiation onto the mirror. Plasma shapes between a sphere and a cylinder, such as an ellipsoid of revolution, may be generated using an appropriate array of neutral beams.

Figure 5:
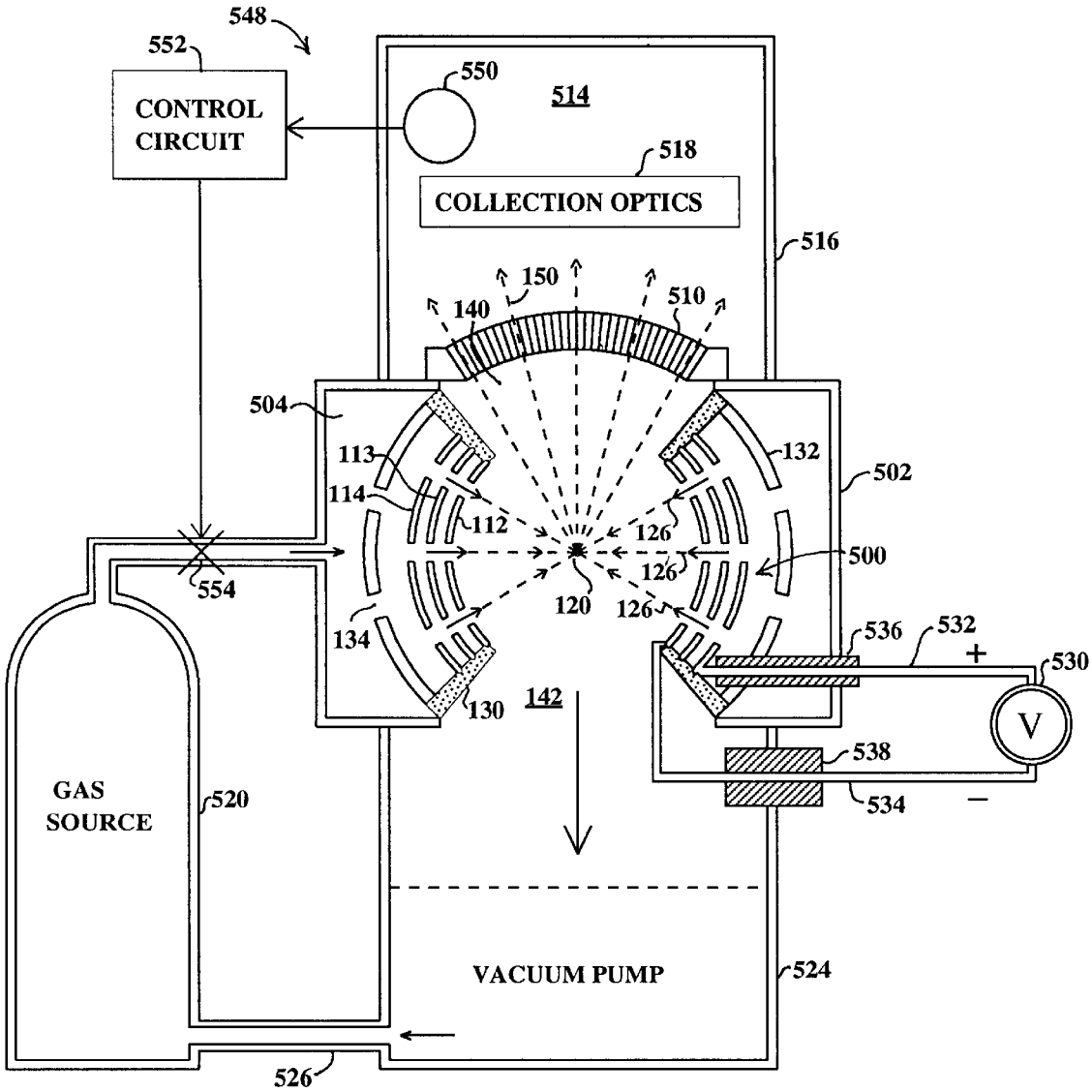
FIG. 5 is a schematic representation of an embodiment of a system for generating extreme ultraviolet photons in accordance with the invention.

An embodiment of a system for generating photons in accordance with the invention is shown schematically in FIG. 5. An acceleration structure 500 may correspond to the acceleration structure 100 shown in FIGS. 2A and 2B, the acceleration structure 300 shown in FIGS. 3A and 3B, the acceleration structure 400 shown in FIGS. 4A and 4B, or any other acceleration structure within the scope of the present invention. In the example of FIG. 5, acceleration structure 500 corresponds to acceleration structure 100, shown in FIGS. 2A and 2B and described above. Like elements in FIGS. 2A, 2B and 5 have the same reference numerals.

Acceleration structure 500 and plenum 132 are enclosed within a housing 502 that defines a discharge chamber 504. The top aperture 140 of acceleration. structure 500 is coupled through a screen 510 to a collection region 514 that is defined by an enclosure 516. Enclosure 516 contains collection optics 518 for relaying the photon beam 150 to a remote point of use. As discussed below, screen 510 allows propagation of photons from discharge chamber 504 to collection region 514 but impedes flow of gas from discharge chamber 504 to collection region 514. A gas source 520 coupled to housing 502 supplies a working gas through ports 134 in plenum 132 to acceleration structure 500. Bottom aperture 142 of acceleration structure 500 is coupled to a vacuum pump 524. An outlet 526 of vacuum pump 524 is connected to gas source 520 to form a gas recirculation system. The gas source 520 and the vacuum pump 524 are connected to housing 502 in a closed-loop configuration that permits recirculation of the working gas through discharge chamber 504. Gas source 520 may include elements for removing impurities and particulates from the working gas.

A pulsed voltage source 530 is connected via electrical conductors 532 and 534 to electrode shells 114 and 112, respectively. Pulsed voltage source 530 is located external to housing 502, and conductors 532 and 534 pass through insulated feedthroughs 536 and 538, respectively, to acceleration structure 500. The positive terminal of voltage source 530 is connected to outer electrode shell 114, and the negative terminal of voltage source 530 is connected to inner electrode shell 112. The pulsed voltage source 530 may be a solid state switched, magnetically modulated pulse generator.

The screen 510 that separates plasma discharge region 120 from enclosure 512 may have a honeycomb structure, including multiple small bore holes aligned with the local propagation directions of photon beam 150. The screen 510 impedes gas flow from discharge chamber 504 into collection region 514, while allowing photons to pass with little attenuation. The screen 510 therefore allows a pressure differential between discharge chamber 504 and collection region 514, with a higher pressure sufficient for charge exchange in discharge chamber 504, and a lower pressure that allows efficient propagation of the photon beam in collection region 514. Screen 510 can be made of a highly thermally conducting material to remove plasma heat and to protect the collection optics in collection region 514. Screen 510 may be fabricated from an electrically insulating material, such as silicon carbide, or an electrically conducting material, such as copper.

The system may include a feedback control system 548 for controlling the rate of flow of the working gas into the discharge chamber 504 in response to a measured spectrum of the radiated photons. The feedback control system 548 includes a detector 550 located in collection region 514, a control circuit 552 and a flow controller 554. The detector 550 is coupled through control circuit 552 to flow controller 554. Flow controller 554 is located so as to control flow of the working gas into discharge chamber 504. In one example, detector 550 samples the extreme ultraviolet spectrum of the radiated photons at two wavelengths coincident with prominent spectral features. For example, in the xenon spectrum a first detector samples the intensity at 13.4 nanometers and a second detector samples the intensity at 11.4 nanometers. Each of these detectors may include a multilayer mirror that reflects a narrow bandwidth of the radiation onto a separate silicon diode. The 13.4 nanometer band is reflected by a molybdenum-silicon multilayer mirror, and the 11.4 nanometer band is reflected by a silicon-beryllium multilayer mirror. The ratio of the signal at 13.4 nanometers to the signal at 11.4 nanometers is determined by control circuit 552 and is used to calculate a control signal to flow controller 554. If the ratio is higher than a desired value, then the plasma is too cool and the gas pressure is reduced slightly. If the ratio is lower than the desired value, the gas pressure is increased slightly. In this manner, the feedback control system 548 maintains the stability of the extreme ultraviolet emission spectrum.

The invention has been described in connection with generating photons in the extreme ultraviolet and soft X-ray wavelength ranges. The extreme ultraviolet wavelength range is normally considered to include the range of 10 nanometers to 100 nanometers, and the soft X-ray wavelength range is normally considered to include the range of 0.1 nanometer to 10 nanometers. The invention is not limited to these wavelength ranges and may be used for generating photons in other wavelength ranges.

In one example, argon was used as the working gas and the production of extreme ultraviolet radiation in the 40 to 120 nanometer wavelength range was demonstrated. A cathode shell, an anode shell and one intermediate electrode shell carried aligned sets of 3 millimeter diameter holes that defined 64 acceleration columns, all aligned along axes which passed through the center of a sphere. The plasma formed at the center of the sphere radiated from a volume of less than 3 millimeters in diameter, although the innermost electrode shell had an internal diameter of 50 millimeters. In this test the energy applied to the device was 6 Joules, the argon pressure was in the range of 40 millitorr, and a spectrometer was situated 150 centimeters distant from the plasma. The extreme ultraviolet radiation was sufficiently intense to allow collection of the whole spectrum in a single pulse of the device. In a demonstration of its potential for high repetition rate operation, the device was pulsed at up to 300 Hz.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A source of photons comprising:

a discharge chamber;

a plurality of ion beam sources in the discharge chamber, each electrostatically accelerating a beam of ions of a working gas toward a plasma discharge region; and a neutralizing mechanism for at least partially neutralizing said ion beams before they enter the plasma discharge region, wherein the neutralized beams enter the plasma discharge region and form a hot plasma that radiates photons.

2. A source as defined in claim 1 wherein said ion beam sources comprise pulsed ion beam sources.

3. A source as defined in claim 1 wherein said ion beam sources comprise continuous ion beam sources.

4. A source as defined in claim 1 wherein said plasma discharge region has a spherical shape and wherein said ion beam sources are distributed around the spherical plasma discharge region.

5. A source as defined in claim 1 wherein the plasma discharge region has a cylindrical shape and wherein said ion beam sources are distributed around the cylindrical plasma discharge region.

6. A source as defined in claim 1 wherein said plurality of ion beam sources comprises concentric electrode shells having sets of apertures aligned along axes which pass through the plasma discharge region, a voltage source for applying a voltage between said electrode shells, and a gas source for supplying the working gas to the sets of apertures in said electrode shells.

7. A source as defined in claim 6 wherein said electrode shells comprise a cathode shell and an anode shell.

8. A source as defined in claim 7 wherein said electrode shells further comprise one or more intermediate shells between said cathode shell and said anode shell.

9. A source as defined in claim 6 wherein said electrode shells are configured to produce pseudospark discharges.

10. A source as defined in claim 6 wherein said electrode shells are configured as tandem pseudospark discharges.

11. A source as defined in claim 1 wherein said neutralizing mechanism comprises resonant charge exchange in each of said ion beams.

12. A source as defined in claim 1 wherein said photons are in the soft X-ray or extreme ultraviolet wavelength range.

13. A source as defined in claim 1 wherein the working gas is xenon and wherein the radiated photons have wavelengths in a range of about 10–15 nanometers.

14. A source as defined in claim 1 wherein the working gas is selected from the group consisting of lithium, helium, neon, argon and krypton.

15. A photon source comprising:

a discharge chamber containing a working gas;

concentric electrode shells in said discharge chamber, said electrode shells having sets of apertures aligned along axes which pass through a plasma discharge region;

a voltage source for applying a voltage between said electrode shells, wherein beams of ions of the working gas are directed along said axes toward the plasma discharge region; and a neutralizing mechanism for at least partially neutralizing said ion beams before they enter the plasma discharge region, wherein the neutralized beams enter the plasma discharge region and form a hot plasma that radiates photons.

16. A photon source as defined in claim 15 wherein said voltage source is pulsed.

17. A photon source as defined in claim 15 wherein said voltage source generates pulses having pulse widths in a range of about 10–1000 nanoseconds.

18. A photon source as defined in claim 15 wherein said voltage source is continuous.

19. A photon source as defined in claim 15 wherein the voltage applied between said electrode shells is in a range of about 5–50 kilovolts.

20. A photon source as defined in claim 15 wherein the working gas comprises xenon and wherein the radiated photons have wavelengths in a range of about 10–15 nanometers.

21. A photon source as defined in claim 15 wherein the working gas is selected from the group consisting of lithium, helium, neon, argon and krypton.

22. A photon source as defined in claim 15 wherein the working gas has a pressure in a range of about 1–100 millitorr.

23. A photon source as defined in claim 15 wherein said electrode shells are substantially spherical in shape.

24. A system for generating photons, comprising:

a housing defining a discharge chamber;

concentric electrode shells located in the discharge chamber, said electrode shells having sets of apertures aligned along axes which pass through a plasma discharge region;

a voltage source for applying a voltage between said electrode shells;

a gas source for supplying a working gas to the discharge chamber, wherein beams of ions of the working gas are directed along said axes toward the plasma discharge region;

a neutralizing mechanism for at least partially neutralizing said ion beams before they enter the plasma discharge region, wherein the neutralized beams enter the plasma discharge region and form a hot plasma that radiates photons; and a vacuum system for controlling the pressure of the working gas in the discharge chamber.

25. A system as defined in claim 24 wherein the plasma discharge region is spherical in shape.

26. A system as defined in claim 24 wherein the plasma discharge region is cylindrical in shape.

27. A system as defined in claim 24 wherein said gas source and said vacuum system are connected to provide circulation of the working gas through the discharge chamber.

28. A system as defined in claim 24 further comprising a feedback control system for controlling the rate of flow of the working gas into the discharge chamber in response to a measured spectrum of the radiated photons.

29. A system as defined in claim 28 wherein said feedback control system comprises a photon detector for detecting the spectrum of the radiated photons and a flow controller responsive to the measured photon spectrum for controlling the flow of working gas into the discharge chamber.

30. A system as defined in claim 24 wherein said housing includes a structure for passing the radiated photons comprising a honeycomb screen having a plurality of holes aligned with the direction of propagation of the radiated photons.

31. A system as defined in claim 24 wherein the plasma discharge region has a volume in a range of about 0.001 to 0.1 cubic centimeter.

32. A system as defined in claim 24 wherein the ion beams have energies in a range of about 100 eV to 10 keV.

33. A method for generating photons, comprising the steps of:

electrostatically accelerating a plurality of beams of ions of a working gas toward a plasma discharge region; and at least partially neutralizing said ion beams before they enter the plasma discharge region, wherein the neutralized beams enter the plasma discharge region and form a hot plasma that radiates photons.

34. A method as defined in claim 33 wherein the step of electrostatically accelerating a plurality of beams of ions comprises directing a plurality of pulsed ion beams toward the plasma discharge region.

35. A method as defined in claim 33 wherein the step of at least partially neutralizing said ion beams comprises providing electrons for transport with said ion beams to the plasma discharge region.

36. A method as defined in claim 33 wherein the step of at least partially neutralizing said ion beams comprises promoting resonant charge exchange in each of said ion beams.

37. A method as defined in claim 33 further comprising the step of controlling the rate of flow of the working gas into a discharge chamber containing the plasma discharge region in response to a measured spectrum of the radiated photons.

* * * * *

UNITED STATES PATENT AND TRADEMARK OFFICE

CERTIFICATE OF CORRECTION

PATENT NO. : 6,421,421 B1
DATED : July 16, 2002
INVENTOR(S) : Malcolm W. McGeoch It is certified that error appears in the above-identified patent and that said Letters Patent is hereby corrected as shown below:

Title page,
Item [54], Title, should read -- EXTREME ULTRAVIOLET SOURCE BASED ON COLLIDING NEUTRAL BEAMS --.

Signed and Sealed this

Eighteenth Day of October, 2005

JON W. DUDAS
*Director of the United States Patent and Trademark Office*